United States Patent [19]

Oliver, Jr.

[11] Patent Number: 4,562,620

[45] Date of Patent: Jan. 7, 1986

[54] BELT BUCKLE FOR HOLDING A CAN OF SMOKELESS TOBACCO

[76] Inventor: W. Wayne Oliver, Jr., Rte. 13, Box 394A, Maryville, Tenn. 37801

[21] Appl. No.: 519,678

[22] Filed: Aug. 2, 1983

[51] Int. Cl.[4] ..... A44B 11/00

[52] U.S. Cl. ..... 24/163 K; 24/3 F; 224/163; 248/115; 248/314

[58] Field of Search ..... 24/3 R, 3 A, 3 E, 3 F, 24/3 H, 3 J, 3 L, 49 K, 163 R, 163 K; 40/21 C; D2/400, 406, 420; D27/43; 206/0.8, 0.81, 0.82, 0.84, 449, 560; 224/163, 224, 232, 255; 248/115, 213, 300, 314

[56] References Cited

U.S. PATENT DOCUMENTS

| | | | |
|---|---|---|---|
| D. 161,571 | 1/1951 | Dauenhauer | D2/400 |
| D. 220,077 | 3/1971 | Weingardt | D2/406 |
| D. 271,061 | 10/1983 | Zimmerman | D2/400 |
| 630,186 | 8/1899 | Cowles | 248/115 |
| 986,158 | 3/1911 | Florsheim | 24/3 F X |
| 1,237,700 | 8/1917 | Roberts | 206/0.81 X |
| 1,383,968 | 7/1921 | Perry, Jr. et al. . | |
| 1,478,510 | 12/1923 | Dusek | 24/3 F X |
| 1,573,239 | 2/1926 | Gilliland . | |
| 1,599,419 | 9/1926 | Klein . | |
| 1,631,371 | 7/1927 | Greubel . | |
| 1,712,680 | 5/1929 | Svensson . | |
| 1,874,813 | 8/1932 | Saunders | 248/115 |
| 1,961,067 | 5/1934 | Mix . | |
| 2,182,194 | 12/1939 | Blau . | |
| 2,553,904 | 5/1951 | Eslick | 206/0.8 X |
| 2,840,875 | 7/1958 | Chambers | 24/163 K |
| 3,969,836 | 7/1976 | DuBois | 40/21 C |

FOREIGN PATENT DOCUMENTS

| | | |
|---|---|---|
| 764910 | 3/1934 | France . |
| 464313 | 4/1937 | United Kingdom . |

*Primary Examiner*—William E. Lyddane
*Assistant Examiner*—James R. Brittain
*Attorney, Agent, or Firm*—Luedeka & Neely

[57] ABSTRACT

The specification discloses a belt buckle for holding a can of smokeless tobacco which includes a plate for attachment to a belt and a clasp to join the ends of the belt. A cylindrically-shaped recess is formed in the plate which has a diameter slightly larger than the can of smokeless tobacco, and three lugs are mounted on the plate adjacent to the recess adjacent the lower 180° portion of the recess. The can is inserted in a downward direction into the recess between the recess and the lugs. The recess and the lugs act cooperatively to compress and flex the can of smokeless tobacco during insertion and a locking action is effected on the can of smokeless tobacco when the can returns to its original configuration when disposed within the recess.

3 Claims, 5 Drawing Figures

BELT BUCKLE FOR HOLDING A CAN OF SMOKELESS TOBACCO

The present invention relates to belt buckles for holding objects and particularly relates to a belt buckle for holding a can of smokeless tobacco.

Consumers of smokeless tobacco may purchase supplies of that product in cylindrical containers (referred to as "cans") which are generally constructed of cardboard or plastic having a lid made from plastic or thin metal. In this construction, the cans have a slight resilient flexibility and the various brands of smokeless tobacco are typically sold in cans of the same size. Also, the manufacturers usually stamp the brand names of the product and a decorative design into the lid.

Many consumers of smokeless tobacco like to enjoy their tobacco during activities or employment which requires them to move about. Often the consumers wish to have a supply of smokeless tobacco close at hand while they move from place to place, but the smokeless tobacco can may be burdensome and uncomfortable when carried in a pants or shirt pocket. Therefore, a need has arisen for an article or device that may be used by the consumer to conveniently and comfortably carry a can of smokeless tobacco.

To fulfill this need, a belt buckle is provided by the present invention to carry a can of smokeless tobacco. This belt buckle utilizes the resilient flexibility of the can to effect a convenient and inexpensive locking action between the can and the belt buckle. Such locking action will prevent the movements of the consumer from dislodging the can from the buckle but will allow easy removal by the consumer. In addition, the belt buckle allows display of the thin metal lid to utilize the can lid as an ornamental feature of the belt buckle.

Known belt buckles for carrying other articles generally employ complicated attachment mechanisms which are potentially cumbersome in use. For example, some buckles are adapted to receive a screw-on container for holding various substances. A certain amount of time and effort is necessary to remove and replace such a container. These buckles are not adaptable to hold a can of smokeless tobacco.

The belt buckle of the present invention, on the other hand, provides a consumer of smokeless tobacco with a holder for a can of smokeless tobacco which is extremely easy to use. In one of the preferred embodiments, the buckle includes a plate having a recess and a plurality of lugs. The can is inserted into the buckle from above and the plurality of lugs guide the can into the recess. The can may be inserted and removed easily with one hand even though the can is held firmly in the buckle by the reslilient flexibility of the can. Also, the belt buckle of the present invention allows for essentially full display of the metal lid if such display is desired. Alternately, the design of the buckle may be easily adapted to include decorative aspects which compliment the display of the metal lid.

In accordance with one form of the present invention, there is provided a buckle for a belt for receiving and holding a resilient, cylindrical article such as a smokeless tobacco can. The belt buckle includes a plate for attachment to the belt which forms a clasp to join the ends of the belt. A plate surface is formed on the plate, and structure is provided having an underside surface that is spaced apart from the plate surface. Also attached to the plate is a structure for guiding the cylindrical article into a position on the plate between the plate surface and the underside surface when the cylindrical object is inserted into the buckle. The same structure holds the cylindrical article in the position on the plate surface adjacent the underside surface when the cylindrical article is fully inserted in the buckle. The guiding and holding structure and the underside surface act cooperatively upon the cylindrical article during insertion to compress and flex the object, and thus, a locking action is effected when the cylindrical article is positioned between the underside surface and said plate surface. The buckle prevents the cylindrical article from being dislodged when the entire buckle is subjected to movement.

In accordance of a more particular form of the present invention, there is provided a buckle for a belt for receiving and holding a resilient, cylindrical article. The buckle includes a plate for attachment to the belt and forms a clasp to join the ends of the belt. A shallow, cylindrically shaped recess for receiving one end of the cylindrical article is formed in the plate. The recess has a diameter slightly larger than the diameter of the cylindrical article. Structure on the plate is operable for guiding the cylindrical article into the recess when the cylindrical article is inserted into the buckle. The same structure holds the cylindrical article in position with one end of the article in the recess. This guiding and holding structure and the recess act cooperatively on the cylindrical article during insertion to compress and flex the object to effect a locking action. The buckle prevents the cylindrical article from being dislodged when the entire buckle is subjected to movement.

In accordance with a particular aspect of the present invention, the mechanism for guiding and holding the cylindrical article is a plurality of lugs mounted on the plate adjacent to the perimeter of the recess. Each of said lugs has a perpendicular portion extending outwardly from the surface of the plate in a generally perpendicular direction relative to the plate and has a length equal approximately to the height of the cylindrical object minus the depth of the recess. Each of the lugs also has a parallel portion extending toward the center of the recess from the top of the perpendicular portion in a direction generally parallel to the surface of the plate.

In accordance with another more particular aspect of the present invention, the belt buckle is dimensioned for receiving and holding a can of smokeless tobacco. A plurality of lugs for guiding and holding the can of smokeless tobacco are dimensioned to display the lid of smokeless tobacco can as an ornamental design on the belt buckle.

In accordance with another form of the present invention, the belt buckle includes a T-shaped bridge member joining the plurality of lugs.

The present invention may be best understood by reference to the following detailed description when considered in conjunction with the accompanying drawings in which.

Figure 1:
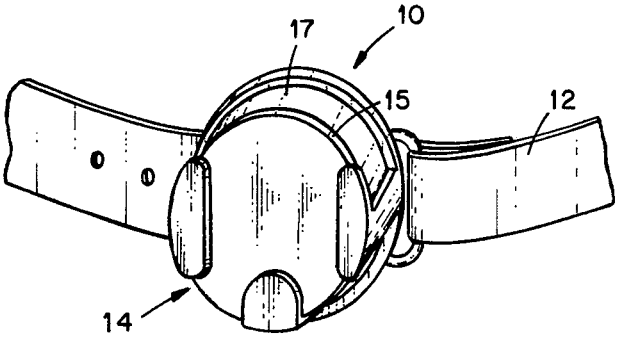
FIG. 1 is a perspective view of one form of the belt buckle of the present invention shown attached to a belt and further showing a can of tobacco fitted into the buckle.

Referring now to the drawings in which like reference characters designate like and corresponding parts throughout the several views, there is shown in FIG. 1, one form of the belt buckle 10 of the present invention. The belt buckle 10 is shown attached to a belt 12 and a smokeless tobacco can 14 is shown fitted in the buckle. The smokeless tobacco can 14 includes a lid 15 which is intentionally prominently displayed by the buckle 10 and a can bottom 17.

Figure 2:
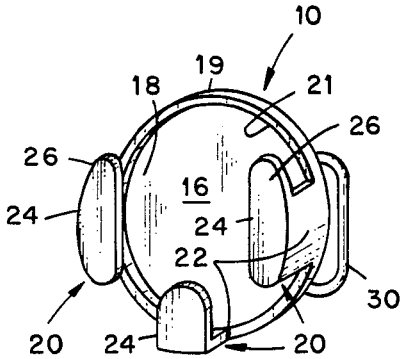
FIG. 2 is a perspective view of one form of the belt buckle of the present invention.

Referring now to FIG. 2, which shows the belt buckle 10 separately, the structure of the belt buckle 10 may be described. The buckle 10 is constructed from a circular plate 16 having a shallow cylindrically shaped recess 18. The cylindrically shaped recess 18 has a diameter slightly larger than the diameter of the can 14 and leaves an annular rim 19 at the perimeter of the circular plate 16. The circular plate 16 is made from a malleable metal such as brass and the recess 18 and corresponding annular rim 19 may be formed in one of several ways. The recess 18 may be formed into the plate 16 if the plate 16 is molded or may be cut into the plate by lathe-turning or other such means. Alternately, a ring may be attached at the perimeter of the circular plate 16 which results in the annular rim 19 on the circular plate 16 at its perimeter and, thus, encircles the recess 18. Regardless of the method used to form the recess 18 an abutment surface 21 on the top inside surface defining the recess is also produced (See also FIG. 4). Mounted on the plate 16 adjacent to the perimeter of the recess 18 are three lugs 20. The lugs 20 may be made out of the same metal as the plate 16 and may be attached to the plate 16 by soldering or other such methods. Two of the lugs 20 are mounted on the plate 16 at approximate points generally indicated by a horizontal line passing through the center of the recess 18. The third lug 20 is mounted on a plate 16 adjacent to the recess 18 at the lowermost point of the recess 18 on the plate 16. The lugs 20 are therefore located generally about the lowermost 180° portion of the recess 18.

Each of the lugs 20 includes a perpendicular portion 22. (Two of the perpendicular portions 22 are shown in FIG. 2.) The perpendicular portions 22 have a length equal approximately to the height of the smokeless tobacco can 14 minus the depth of the recess 18. The perpendicular portions 22 are arced to conform to the shape of the recess 18 and to conform to the shape of the circular plate 16. The thickness of the perpendicular portions 22 is generally the same as the thickness of the rim 19. Thus, the inside surface of the perpendicular portions 22 are generally flush with the inside surface of the plate 16 defining the recess 18 and the outside surfaces of the perpendicular portions 22 are generally flush with the outside edge of the circular plate 16. Each of the lugs 20 has a parallel portion 24 extending toward the center of the recess 18 from the top of each of the perpendicular portions 22 in a direction generally parallel to the surface of the plate 16. Each parallel portion 24 has an underside surface 23 on the side adjacent to the plate 16 (See FIG. 4). The parallel portions 24 are dimensioned to extend out above the recess 18 and to provide for display of the lid 15. The parallel portions 24 of the two lugs 20 along the center of the plate 16 have upward extensions 26 which extend upwardly a short distance above the horizontal line passing through the mid-point of the recess 18.

Figure 5:
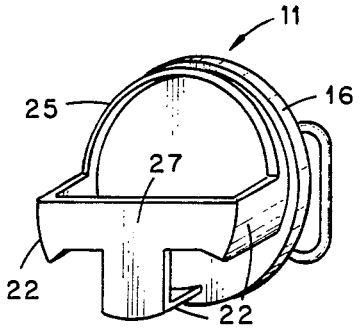
FIG. 5 is a perspective view of an alternate embodiment of the present invention.

An alternate embodiment of the present invention is shown in FIG. 5. This alternate buckle 11 includes a circular plate 16 which is somewhat larger than a can of smokeless tobacco 14. Attached adjacent to the upper plate 16 is an arcuate member 25 with a semicirclar configuration which forms the abutment surface 21. Instead of having individual lugs, the alternate buckle 11 has the perpendicular portions 22 of the buckle 10 being joined by a T-shaped bridge member 27. The perpendicular portions 22 in this embodiment have the same approximate height as the can 14 of smokeless tobacco since there is no actual recess where the perpendicular portions 22 are located.

Figure 3:
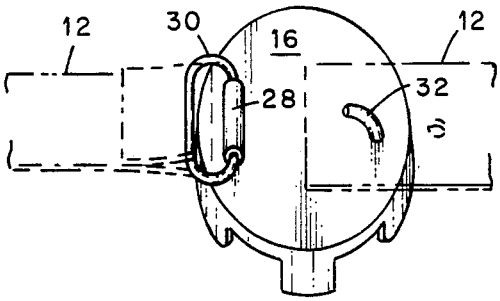
FIG. 3 is a perspective view of the reverse side of the belt buckle of the present invention.

Referring now to FIG. 3, which shows a reverse side of the belt buckle 10, the belt 12 shown in broken lines is attached to the buckle 10. On one side of the back surface of the plate 16 is a tube 28 which is soldered or otherwise attached to the plate 16. A hoop 30 with two parallel, linear sides passes through the tube 28 and is used to attach one end of the belt 12 to the belt buckle 10. An inwardly curved pin 32 is attached to the other side of the circular plate 16 by soldering or other such method. The inwardly curved pin 32 may be inserted through the holes in the belt to attach the other side of the belt 12 to the belt buckle 10. The reverse side of the alternate buckle 11 has a similar structure.

Figure 4:
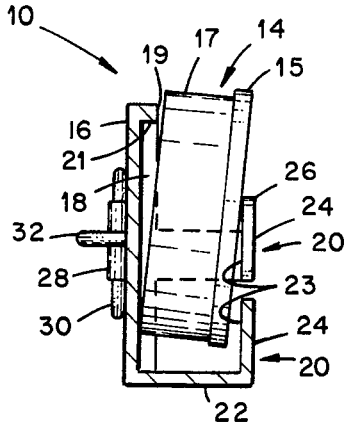
FIG. 4 is a side cross-sectional view of the belt buckle of the present invention showing a can of smokeless tobacco partially inserted in the buckle.

Referring now to FIG. 4, the operation of the belt buckle 10 may be described. In use, a smokeless tobacco can 14 is inserted as shown generally in FIG. 4. The can 14 is inserted at an oblique angle to the plate 16 from the top. The lugs 20 act to guide the smokeless tobacco can 14 into the recess 18 as the can is inserted into the buckle 10. As the can 14 is being inserted, the can 14 is in contact with and slides along the top of the rim 19 and the top of the can 14 is in contact with the underside surfaces 23 of the parallel portions 24 on the two lugs 20 which are located at the horizontal mid-point line of the recess 18. Thus, the two lugs 20 and the recess 18 act cooperatively on the can 14 during insertion to compress and flex the smokeless tobacco can 14, and subject the bottom of the can in contact with the plate 16 to local deformation. When the smokeless tobacco can 14 is fully inserted, the can returns to its original configuration in position on the buckle 10. In this position all three of the lugs 20 prevent the can from being dislodged in any downward or any outward directions. The abutment surface 21 is closely adjacent to or is in contact with the can 14 of smokeless tobacco when the can 14 is fully inserted. The abutment surface 21 prevents the can 14 from being removed from the buckle 10 in any upward directions without flexing and compressing the can 14 by lifting its upper portion away from the surface of the plate 16. Thus, the can of smokeless tobacco 14 is prevented from being dislodged when the buckle 10 is subjected to movement. The alternate buckle 11 operates in a similar manner.

Although particular embodiments of the present invention have been described in the foregoing detailed description, it will be understood that the invention is capable of numerous other rearrangements, modifications and substitutions of parts without departing from the spirit of the invention.

What is claimed is:

1. A buckle for a belt having two ends for receiving and holding upon insertion a can of smokeless tobacco having a bottom made of resilient material and having a lid, said buckle comprising:

a plate having dimensions larger than the diameter of the can of smokeless tobacco;

attachment means for attaching the ends of the belt to said plate;

a shallow cylindrically-shaped recess in said plate having a diameter slightly larger than the diameter of the bottom of the can of smokeless tobacco, said recess defining a rim on said plate about said recess;

a plurality of lugs mounted on said plate adjacent to the perimeter of said recess for guiding the can of smokeless tobacco into said recess when the can is inserted into the buckle and for holding the can of smokeless tobacco on said plate with the bottom of the can of smokeless tobacco being in said recess, said lugs being dimensioned to display the lid of the can of smokeless tobacco as an ornamental design on the belt buckle, said plurality of lugs includes two opposed lugs and an intermediate lug mounted on said plate, each of said lugs having a first portion extending outwardly from and in a direction generally perpendicular to said plate adjacent to the perimeter of said recess and a second portion attached to and supported by said first portion and extending inwardly over said recess in a direction generally parallel to said plate, said two opposed lugs being generally diametrically opposed relative to said recess and said second portions of said opposed lugs covering an area which is intersected by a diameter of said recess, said intermediate lug being spaced-apart from and disposed intermediate said two opposed lugs, and the distance between said second portions of each of said lugs and said plate in said recess being approximately equal and being such that area of said second portions of said two opposed lugs which are remote from said intermediate lug are operable to contact the lid of the can of smokeless tobacco when the can is partially inserted at an oblique angle into the buckle with part of the bottom of the can in contact with said plate in said recess and another part of the bottom in contact with said rim;

said opposed lugs and said rim acting upon the can of smokeless tobacco during insertion to subject the can to local deformation and, upon full insertion, the return of the can to its original configuration aids in holding the can in place in said recess; and said intermediate lug being spaced-apart from and between said opposed lugs to define openings of sufficient size to allow a finger to pass between said intermediate lug and each of said opposed lugs, whereby the can may be removed from the buckle by a single hand by placing two fingers on the can at said openings, placing a thumb on the top of the can, using the thumb to cant the can away from the buckle to a position to clear said rim, and lifting the can out of the buckle with the fingers passing through said openings.

2. The buckle of claim 1 wherein said plate is circular and defines an annular rim about said recess.

3. The buckle of claim 2 wherein said perpendicular portions of said lugs are curved to conform to the shape of the perimeter of said recess and having a thickness approximately the same as the thickness of said annular rim.

* * * * *